US007230237B2

(12) United States Patent
Ueno

(10) Patent No.: US 7,230,237 B2
(45) Date of Patent: Jun. 12, 2007

(54) MASS SPECTROMETER

(75) Inventor: Yoshihiro Ueno, Kyoto-fu (JP)

(73) Assignee: Shimadzu Corporation, Kyoto (JP)

( * ) Notice: Subject to any disclaimer, the term of this patent is extended or adjusted under 35 U.S.C. 154(b) by 107 days.

(21) Appl. No.: 11/075,719

(22) Filed: Mar. 10, 2005

(65) Prior Publication Data

US 2005/0199803 A1 Sep. 15, 2005

(30) Foreign Application Priority Data

Mar. 11, 2004 (JP) ..... 2004-068365

(51) Int. Cl.
*H01J 49/00* (2006.01)

(52) U.S. Cl. ..... 250/290; 250/288; 250/281; 250/287; 250/292

(58) Field of Classification Search ..... None
See application file for complete search history.

(56) References Cited

U.S. PATENT DOCUMENTS

| | | | | |
|---|---|---|---|---|
| 6,087,657 | A * | 7/2000 | Kato | 250/288 |
| 6,188,066 | B1 | 2/2001 | Whitehouse et al. | |
| 6,977,371 | B2 * | 12/2005 | Bateman et al. | 250/288 |
| 7,064,319 | B2 * | 6/2006 | Hashimoto et al. | 250/287 |

FOREIGN PATENT DOCUMENTS

| | | |
|---|---|---|
| EP | 0 813 228 A1 | 12/1997 |
| EP | 1 255 619 A2 | 7/2002 |
| EP | 1 533 829 A2 | 5/2005 |
| JP | 2000-149865 | 5/2000 |

OTHER PUBLICATIONS

Shenheng Guan et al., "Stacked-Ring Electrostatic Ion Guide", Journal of American Society for Mass Spectrometry, Jul. 1996, pp. 101-106.
EP 05 00 5176 European Search Report dated Sep. 27, 2006.

* cited by examiner

*Primary Examiner*—Jack I. Berman
*Assistant Examiner*—Zia R. Hashmi
(74) *Attorney, Agent, or Firm*—Westerman, Hattori, Daniels & Adrian, LLP.

(57) ABSTRACT

A mass spectrometer adopting a differential pumping system includes an ionization chamber with substantially atmospheric pressure, two intermediate vacuum chambers, and a mass analyzing chamber with a very low pressure (or a very high vacuum), where the pressures of these chambers are in the order of higher to lower. A hole is provided in every wall between two adjoining chambers for allowing ions to be mass analyzed to pass through. An auxiliary electrode with an aperture is placed near the hole, and an AC voltage is applied to the auxiliary electrode. Owing to an AC electric field generated by the AC voltage around the hole, an ion coming near the hole is exerted with such a force that confines the ion to the ion optical axis C. Under these circumstances, even when the ion collides with a residual gas molecule or atom and is deflected away from the ion optical axis, the confining force exerted by the electric field pulls the ion back toward the ion optical axis. This improves the ion passing efficiency of the hole, and increases the number of ions reaching the mass filter and ion detector, which consequently enhances the sensitivity of the mass analysis.

12 Claims, 3 Drawing Sheets

MASS SPECTROMETER

The present invention relates to a mass spectrometer, specifically to one that has a differential pumping system, such as an atmospheric pressure ionizing mass spectrometer.

BACKGROUND OF THE INVENTION

Mass spectrometers are often used in combination with a liquid chromatograph or a gas chromatograph. In the case of a mass spectrometer combined with a liquid chromatograph (LCMS), the mass spectrometer is used as the detector of the liquid chromatograph. In the liquid chromatograph, a sample liquid containing components to be detected is made to flow through a liquid chromatograph column, where the components are separated with respect to time while the sample passes through the column. The liquid (eluate) flowing out of the column is ionized by an interface, and the ionized component atoms or molecules are introduced into the mass spectrometer where the ions are separated by their mass to charge ratios. Ions of the components thus separated in the mass spectrometer are detected by an ion detector.

In a LCMS, the eluate is normally ionized under the atmospheric pressure, so that the interfaces are generally called an atmospheric pressure ionizing (API) interface. The electro-spray ionizing (ESI) interface and atmospheric pressure chemical ionizing (ACPI) interface are typical API interfaces.

In the mass spectrometers using API interfaces, the ionizing chamber is kept at substantially atmospheric pressure, but the mass spectrometer section, which includes a mass filter such as a quadrupole mass filter and the ion detector, must be kept at a very low pressure (or in a very high vacuum). Since the pressure difference is so large, several (usually two) intermediate vacuum chambers are provided between the ionizing chamber and the MS section, and the pressures of the intermediate vacuum chambers are gradually changed in order to keep the mass spectrometer section at very low pressure. The Unexamined Japanese Patent Publication No. 2000-149865 (which has matured to U.S. Pat. No. 3,379,485) describes one of such differential pumping systems.

In differential pumping systems, ions are passed from a chamber of a higher pressure to an adjoining chamber of a lower pressure through a small hole called an orifice. In order to keep the low pressure of the lower pressure chamber, it is preferable to prevent unnecessary gas molecules from passing through the orifice. But, on the other hand, the object component ions should pass through the orifice at as large an amount as possible in order to enhance the detecting sensitivity. Conventionally, an ion lens applied with a DC voltage (an electrostatic lens) is provided before the orifice of an intermediate vacuum chamber, and the rear focal point of the ion lens is set at the orifice, so that object ions are converged and effectively injected into the orifice.

The conventional ion lens has the following drawback. In a mass spectrometer using an API interface, a considerable amount of gas (residual gas) remains in the ionizing chamber and subsequent low-pressure intermediate vacuum chambers, and it often happens that the sample ions contact the molecules of the residual gas. If an ion being converged by the ion lens contacts a residual gas molecule, the ion is deflected and is difficult to converge again to the orifice with the electric field by the ion lens alone. Since the concentration of the ions at the converging point (or near the rear focal point) of the ion lens is very large, the ions are highly probable to collide with the residual gas molecules, and to be prevented from entering the orifice and going to the subsequent chamber. This deteriorates the sensitivity of the sample analysis.

SUMMARY OF THE INVENTION

In view of the above described problems, an object of the present invention is to improve the sensitivity of a mass spectrometer using an API interface by making more ions pass the intermediate vacuum chambers while preventing unnecessary residual gas molecules from doing the same.

Thus the present invention provides a mass spectrometer adopting a differential pumping system and including:

an ionization chamber with substantially atmospheric pressure;

a mass analyzing chamber with a low pressure (or a high vacuum);

one or more intermediate vacuum chambers provided between the ionization chamber and the mass analyzing chamber, all of which form a series of chambers with an order of higher to lower pressure;

a hole provided between adjoining chambers for allowing ions to pass through to be mass analyzed; and an AC electric field generator for generating an AC electric field for confining an ion to the hole.

Owing to the AC electric field, an ion coming near the hole is exerted such a force that the ion is confined to the ion optical axis C. Under these circumstances, even when the ion collides with a residual gas molecule (or atom) and is deflected away from the ion optical axis, the confining force by the electric field pulls the ion back toward the ion optical axis C. Thus the ion will very probably pass through the hole.

Various measures can be taken to generate the AC electric field in the space around the hole. One method is to use the wall (in which the hole is formed) between two adjoining chambers (i.e., between the ionization chamber and the first intermediate vacuum chamber, between two intermediate vacuum chambers, or between the last intermediate chamber and the mass analyzing chamber) as an electrode, and apply an AC voltage to the wall. However, the walls between chambers are often required to be electrically grounded (to 0V) for some other reason. Therefore another method is recommended in which an independent electrode having an aperture near the hole is provided, and the AC voltage is applied to the electrode. The electrode may be placed on the higher pressure chamber side or the lower pressure chamber side, but the higher pressure chamber side is preferable for the following reason. Since ions travel from the higher pressure chamber to the lower pressure chamber, the hole is preferably conically shaped with the larger end on the higher pressure chamber side, and the smaller end on the lower pressure chamber side. In this case, the electrode is better placed on the higher pressure chamber side in order to generate the AC electric field in the space within the conical hole, so that the ions can be adequately confined to the hole.

With the conventional ion lens, once an ion collides with a residual gas molecule and is deflected, it is difficult to force it back to the original course for leading ions to pass through the hole. According to the present invention, a deflected ion can be pulled back toward the hole owing to the AC electric field generated near the hole. This improves the ion passing efficiency through the hole, and increases the number of ions reaching the mass filter and ion detector, which of course enhances the sensitivity of the mass analysis.

The AC voltage (or its amplitude and frequency) applied to the auxiliary electrode 6 may be specifically determined so that the pseudopotential V*(r) generated in the hole satisfies the following formula:

$$V^*(r)=q^2|E_0(r)|^2/4m\Omega^2>E_{kin}/q$$

where q and m are the charge and mass of an ion concerned, $E_0(r)$ is the electric field, Ω is the angular frequency of the AC voltage, $E_{kin}$ [eV] is the radial component of the kinetic energy of the ion.

DETAILED DESCRIPTION OF A PREFERRED EMBODIMENT

Figure 1:
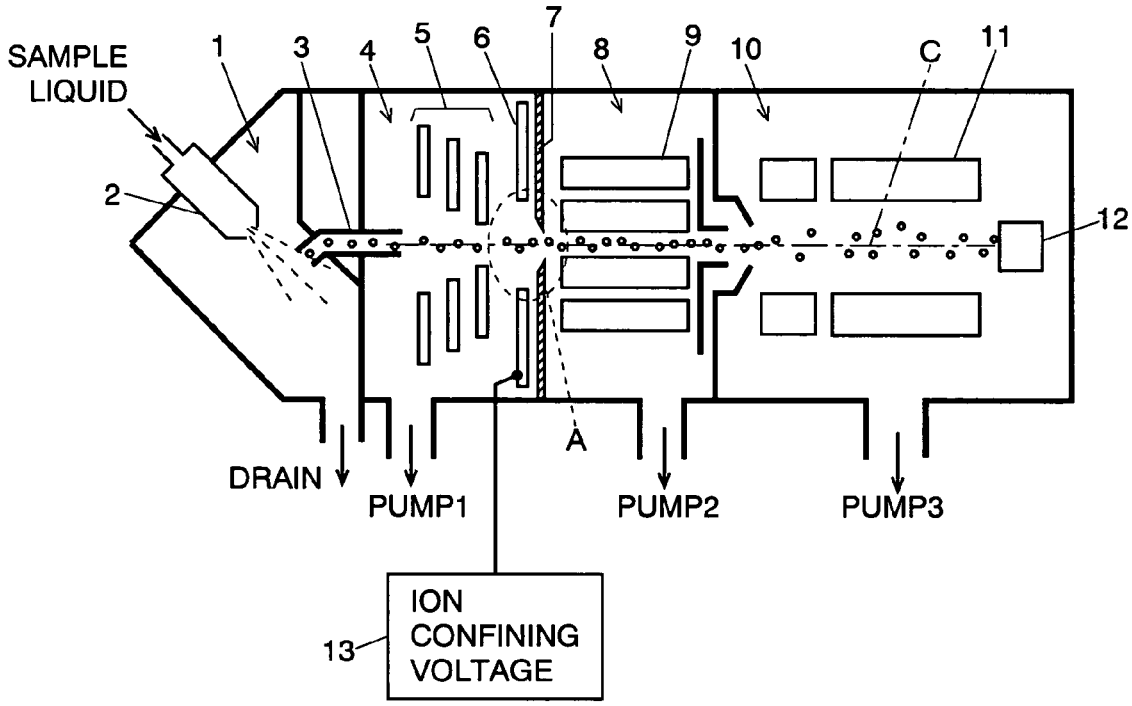
FIG. 1 is a longitudinal sectional view of a mass spectrometer with an ESI interface.

A mass spectrometer using an ESI interface embodying the present invention is described using the accompanying drawings. Though not shown in FIG. 1, a liquid chromatograph is attached to the mass spectrometer, wherein the exit of the column of the liquid chromatograph is connected to the nozzle 2 of the ionizing chamber 1. In the mass spectrometer, a first intermediate vacuum chamber 4 and a second intermediate vacuum chamber 8 are provided between the ionizing chamber 1 and a mass analyzing chamber 10 in which a quadrupole mass filter 11 and an ion detector 12 are accommodated. The chambers 1, 4, 8 and 10 are separated by respective walls, wherein the wall between the ionizing chamber 1 and the first intermediate vacuum chamber 4 is equipped with a dissolvation line 3, and the wall 7 between the first intermediate vacuum chamber 4 and the second intermediate vacuum chamber 8 has an orifice 70. The inner diameters of both the dissolvation line 3 and the orifice 70 are rendered very small.

The pressure in the ionizing chamber 1, which functions as the ion source, is almost atmospheric (i.e., at about $10^5$ Pa), because the liquid sample solution constantly flows from the column of the liquid chromatograph into the ionizing chamber 1 through the nozzle 2 and is vaporized. The pressure in the first intermediate vacuum chamber 4 is kept at about $10^2$ Pa with a rotary pump (PUMP1 in FIG. 1), and that in the second intermediate vacuum chamber 8 is kept at about $10^{-1}$ to $10^{-2}$ Pa with a turbo molecular pump (PUMP2). The mass analyzing chamber 10 is evacuated by another turbo molecular pump (PUMP3) up to such a low pressure of $10^{-3}$ to $10^{-4}$ Pa. Thus these chambers and pumps construct a differential pumping system to maintain the mass analyzing chamber 10 at a very low pressure (or in a very high vacuum).

The sample solution is electro-sprayed by the nozzle 2, to which is applied a high voltage, into the ionizing chamber 1, so that the droplets of the sample solution are given electric charges when sprayed. Through evaporation of the solvent from every droplet, the sample molecules are ionized, though not completely. The mixture of the ionized sample molecules and unionized tiny droplets is drawn into the dissolvation line 3 owing to the pressure difference between the ionizing chamber 1 and the first intermediate vacuum chamber 4, where the ionization of the sample is promoted because the solvent in the droplets is heated and evaporates out. A first ion lens 5 is provided in the first intermediate vacuum chamber 4, which assists the introduction of the ions from the ionizing chamber 1 through the dissolvation line 3, and converges the ions to the orifice 70. In the present embodiment, as shown in FIG. 1, the first ion lens 5 is composed of three rows of electrode units having gradually narrowing apertures aligned along the ion optical axis C, where each electrode unit is composed of four plate electrodes surrounding the ion optical axis C.

In the first intermediate vacuum chamber 4, an auxiliary electrode 6 having a large aperture is provided near the wall 7 to form an AC electric field for confining ions near the orifice 70. The AC electric field will be discussed later. The ions passing through the orifice 70 and entering the second vacuum chamber 8 are converged by a second ion lens 9 and sent to the mass analyzing chamber 10. In the present embodiment, the second ion lens 9 is an octapole type which has eight rod electrodes arranged in parallel and symmetrically around the ion optical axis C. In the mass analyzing chamber 10, only ions having a specific mass to charge ratio can pass through the longitudinal space of the mass filter 11 along the ion optical axis C, while other ions dissipate. The ions passing through the mass filter 11 reach the ion detector 12, which generates a signal corresponding to the number of ions detected.

The first ion lens 5 and the second ion lens 9 both converge ions, while the auxiliary electrode 6 assists more ions to pass through the orifice 70 with a different principle.

To the auxiliary electrode 6 is applied an AC voltage of a predetermined amplitude and predetermined frequency by an ion-confining voltage generator 13, whereby an AC electric field is generated in the space around the aperture of the auxiliary electrode 6. The orifice 70 is conically shaped, as shown in (a) of FIG. 2, with the larger end on the side of the first intermediate vacuum chamber 4. Thus the AC electric field generated by the auxiliary electrode 6 placed on the same side easily intrudes into the space 72 surrounded by the conical wall 71 of the orifice 70. Owing to the AC electric field formed in the conical space 72, an electric pseudo-potential is generated there, whose cross-sectional contour around the ion optical axis C is shown in (b) of FIG. 2.

The pseudo-potential generated by an AC electric field has been studied and explained by Shenheng Guan and Alan G Marshall, "Stacked-Ring Electrostatic Ion Guide", Journal of American Society for Mass Spectrometry, July, 1996, pp. 101–106.

Figure 2:
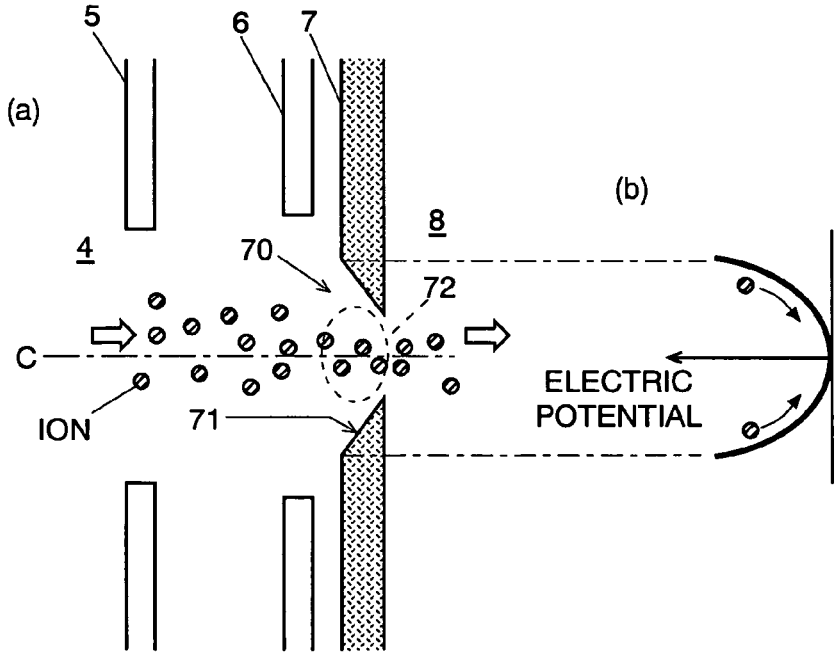
FIG. 2 is an enlarged longitudinal sectional view of the mass spectrometer near an orifice of the mass spectrometer with an electric potential diagram around an ion optical axis C.

The contour of the pseudo-potential shown in (b) of FIG. 2 looks as if a pseudo-potential pocket is formed around the ion optical axis C. In such a field of pseudo-potential, an ion cannot rest at a higher potential and tends to move toward a lower potential. When the ion reaches the lowest potential point, it overruns the point due to its kinetic momentum and climbs the pseudo-potential to a higher position. When the ion loses its kinetic energy in climbing the pseudo-potential slope, it then falls toward the lowest point. Thus ions rock around the ion optical axis C and gradually gather there. If an ion moving toward the orifice 70 is deflected and departs the ion optical axis C due to a collision with a residual gas molecule, it must climb the pseudo-potential, whereby the ion is pulled back to the ion optical axis C. In other words, a path is formed along the ion optical axis C where ions from all directions are confined and pass through. This decreases the number of ions being lost due to collision with the wall 7 and with the conical wall 71 around the orifice 70, and increases the ion passing efficiency through the orifice 70.

The force for confining an ion to the path (and to the orifice 70) depends on the frequency and amplitude of the AC voltage, and the mass to charge ratio of the ion. Therefore it is preferable to adjust either the frequency or the amplitude of the AC voltage according to the mass to charge ratio of an object ion to be analyzed. Generally, adjusting the amplitude is easier than adjusting the frequency. If the mass filter is a quadrupole mass filter, as in the present embodiment, the amplitude of the DC voltage and the AC voltage applied to the quadrupole mass filter is scanned according to the mass to charge ratio of the object ion. Accordingly, the ion-confining voltage generator 13 scans the amplitude of the AC voltage applied to the auxiliary electrode 6 corresponding to the scan of the voltage to the quadrupole mass filter 11. The optimal combination of the frequency and amplitude of the AC voltage can be determined beforehand with experiments or calculations.

Figure 3A:
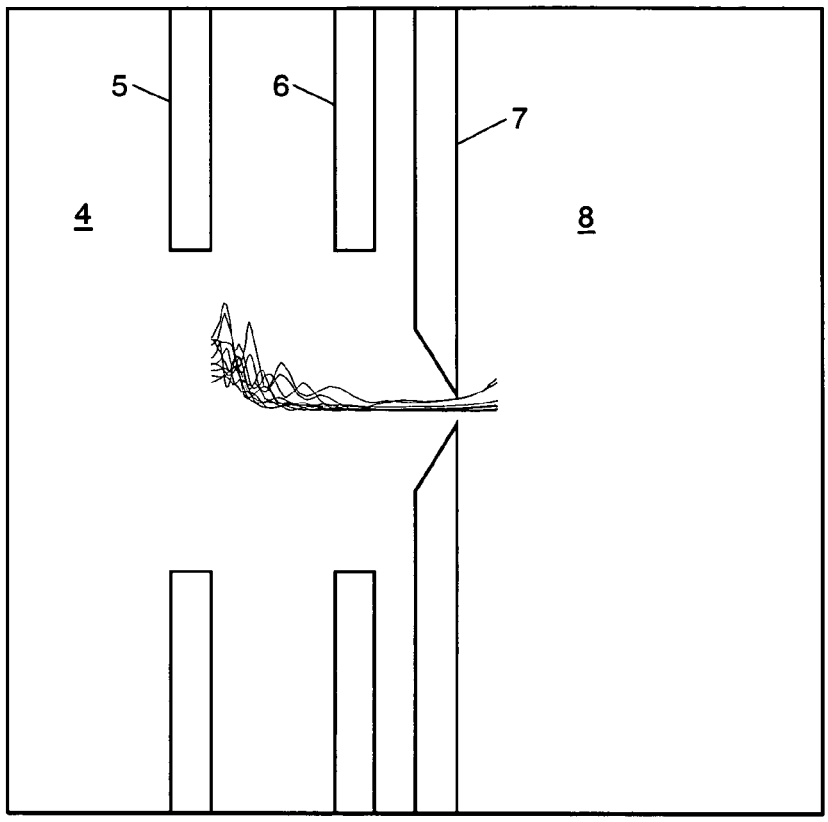
FIG. 3A shows the trajectories of ions around the orifice according to the present invention.
Figure 3B:
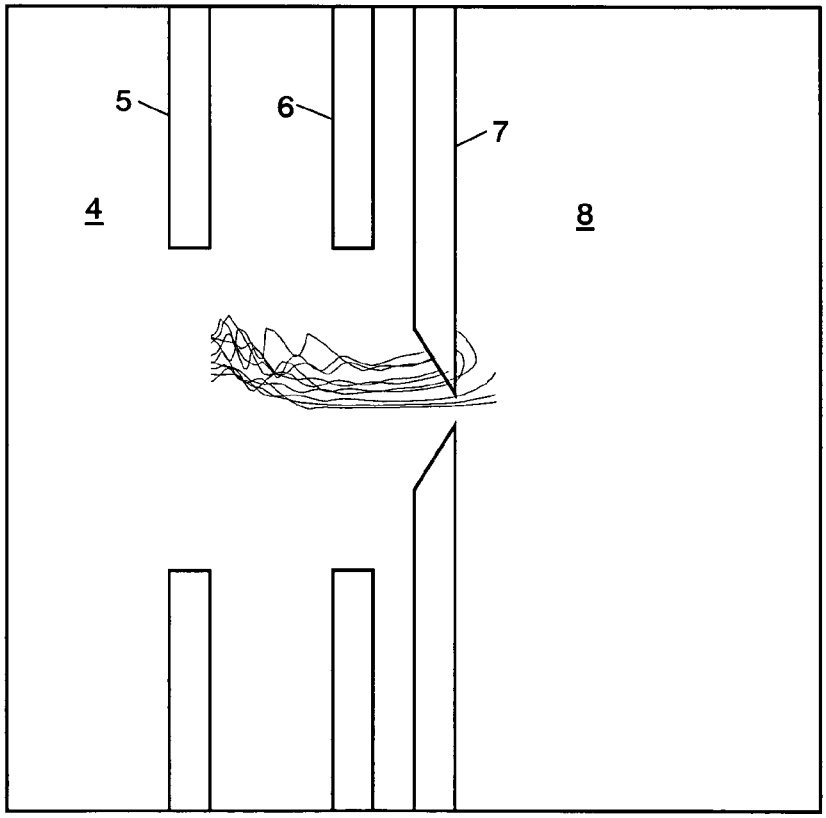
FIG. 3B is the same according to a conventional method.

In order to confirm the ion-confining effect of the above construction, a computer simulation is made to figure out the trajectory of ions around the orifice 70. The results are shown in FIGS. 3A and 3B, where FIG. 3A is the result of applying an appropriate AC voltage to the auxiliary electrode 6, and FIG. 3B is the result of applying no voltage. In the case of FIG. 3B, a large portion of the ions coming to the orifice 70 collide with the wall 7 and with the conical wall 71 around the orifice 70. In the case of FIG. 3A, where the appropriate AC voltage is applied to the auxiliary electrode 6, the ions are confined near the ion optical axis C, and most ions pass through the orifice 70. These figures show that, according to the present invention, fewer ions are lost at the orifice 70, and the ion passing efficiency is improved.

Figure 4A:
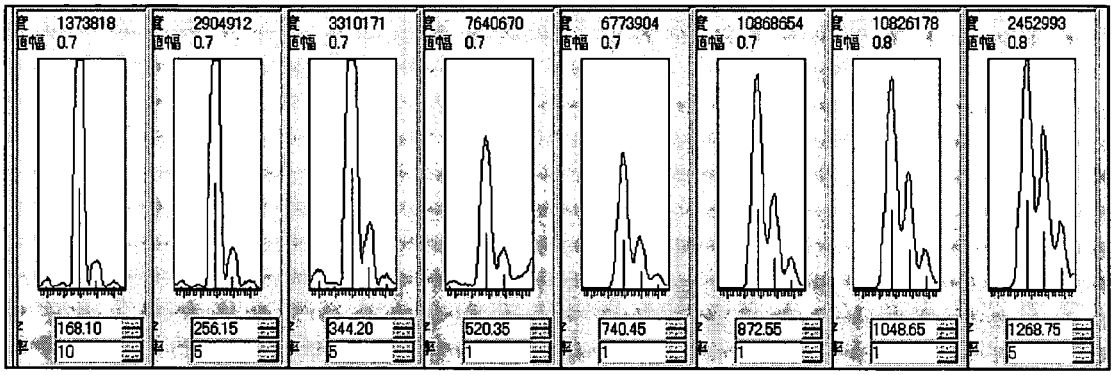
FIG. 4A shows parts of mass spectra obtained in a mass spectrometer according to the present invention.
Figure 4B:
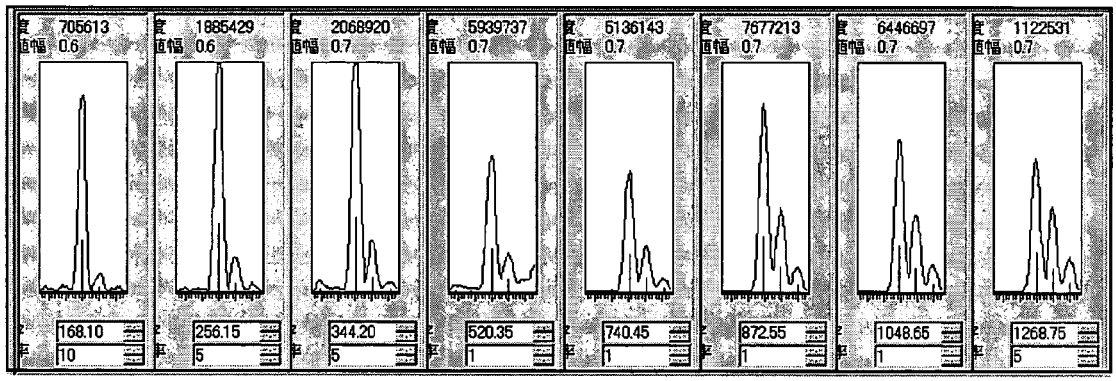
FIG. 4B shows the same according to a conventional method.

Next, the ion passing efficiencies of the case of FIG. 3A and the case of FIG. 3B are actually measured. FIGS. 4A and 4B correspond to the cases of FIGS. 3A and 3B respectively. Both FIGS. 4A and 4B show mass spectra of several ions of different mass to charge ratios, where their values are, from left to right, 168.10, 256.15, 344.20, 520.35, 740.45, 872.55, 1048.65 and 1268.75. Since the scale of the ordinate of the graphs of FIGS. 4A and 4B is the same, the height of the peaks can be compared as they are. As seen from the mass spectra, the ion detection signal is larger in the case of the present invention (FIG. 4A) at all mass to charge ratios tested. This proves that the present invention is effective in improving the sensitivity of a mass analysis, and makes it possible to analyze a tiny amount of sample.

Figure 5A:
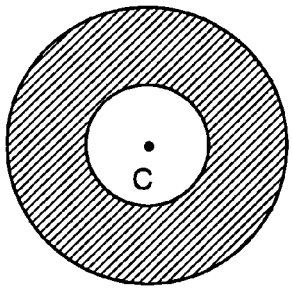
FIGS. 5A–5C are examples of auxiliary electrodes.
Figure 5B:
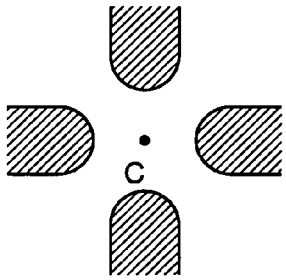
Figure 5C:
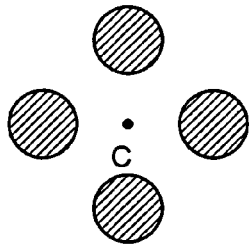

Although only some exemplary embodiments of the present invention have been described in detail above, those skilled in the art will readily appreciate that many modifications are possible without materially departing from the present invention. Accordingly, all such modifications are intended to be included within the scope of the present invention. For example, the auxiliary electrode 6 is provided in the first intermediate vacuum chamber 4 in the above embodiment. Instead of that, the auxiliary electrode 6 may be placed in the second intermediate vacuum chamber 8. Another alternative is that the wall 7 between the two intermediate vacuum chambers 4 and 8 can be used to form the above described confining electric field. However, the wall 7 is generally electrically grounded in actual mass spectrometers. Therefore it is preferable to provide an auxiliary electrode 6 separately from the wall 7. It is further preferable to place the auxiliary electrode 6 just before the wall 7, and shape the orifice 70 conical as shown in FIG. 2 in order to form an adequate AC electric field in the space 72 of the orifice 70. The auxiliary electrode 6 can be shaped other than as a ring as described above and shown in FIG. 5A, but it may be formed by separate plates or discs as shown in FIG. 5B or 5C.

What is claimed is:

1. A mass spectrometer adopting a differential pumping system comprising:

an ionization chamber with substantially atmospheric pressure;

a mass analyzing chamber with low pressure;

one or more intermediate vacuum chambers provided between the ionization chamber and the mass analyzing chamber, all of which form a series of chambers with an order of higher to lower pressure;

a hole provided between adjoining chambers for allowing ions to be mass analyzed to pass through; and an AC electric field generator for generating an AC electric field in the space around the hole for confining an ion to the hole.

2. The mass spectrometer according to claim 1, wherein the AC electric field generator is a combination of an electrode having an aperture placed near the hole and a voltage generator for applying an AC voltage to the electrode.

3. The mass spectrometer according to claim 2, wherein the aperture is placed on a side of a chamber of higher pressure.

4. The mass spectrometer according to claim 3, wherein the hole is conically shaped with a larger diameter on the side of the higher pressure chamber.

5. The mass spectrometer according to claim 2, wherein the electrode is provided in an intermediate vacuum chamber adjoining the ionization chamber.

6. A method of improving a sensitivity of a mass spectrometer adopting a differential pumping system and comprising:

an ionization chamber with substantially atmospheric pressure;

a mass analyzing chamber with low pressure;

one or more intermediate vacuum chambers provided between the ionization chamber and the mass analyzing chamber, all of which form a series of chambers with an order of higher to lower pressure; and a hole provided between adjoining chambers for allowing ions to be mass analyzed to pass through, wherein an AC electric field is generated in a space within the hole for confining ions in the space.

7. The method according to claim 6, wherein the AC electric field is generated by an electrode having an aperture placed near the hole and a voltage generator for applying an AC voltage to the electrode.

8. The method according to claim 7, wherein the aperture is placed on a side of a chamber of a higher pressure.

9. The method according to claim 8, wherein the hole is conically shaped with a larger diameter on the side of the higher pressure chamber.

10. The method according to claim 7, wherein the electrode is provided in an intermediate vacuum chamber adjoining the ionization chamber.

11. The method according to claim 6, wherein a frequency and amplitude of the AC voltage is determined according to a mass to charge ratio of an ion to be analyzed.

12. The method according to claim 11, wherein the amplitude and frequency of the AC voltage is determined so that an AC electric field generated in the hole satisfies the following formula:

$$V^*(r)=q^2|E_0(r)|^2/4m\Omega^2>E_{kin}/q$$

where q and m are the charge and mass of an ion concerned, $E_0(r)$ is the electric field, $\Omega$ is the angular frequency of the AC voltage, $E_{kin}$ [eV] is the radial component of the kinetic energy of the ion.

* * * * *